US006058809A

United States Patent [19]

Flanz

[11] Patent Number: 6,058,809

[45] Date of Patent: May 9, 2000

[54] FAMILY OF DISMANTLING DEVICES

[76] Inventor: Anthony Flanz, 25350 Branchaster, Farmington Hills, Mich. 48336

[21] Appl. No.: 09/062,835

[22] Filed: Apr. 20, 1998

[51] Int. Cl.[7] ..... E04D 15/00

[52] U.S. Cl. ..... 81/45; 254/131; 254/131.5

[58] Field of Search ..... 81/45; 254/131, 254/131.5, 18, 21; 30/172

[56] References Cited

U.S. PATENT DOCUMENTS

| | | | |
|---|---|---|---|
| 738,753 | 9/1903 | Baggett . | |
| 1,559,976 | 11/1925 | Ness . | |
| 1,793,060 | 2/1931 | Clements | 254/131 |
| 2,330,092 | 9/1943 | Vanasse | 254/25 |
| 2,625,370 | 1/1953 | Huggins | 254/131.5 |
| 2,852,228 | 9/1958 | Latiolais | 252/131 |
| 2,864,583 | 12/1958 | Bressler | 254/131 |
| 3,074,694 | 1/1963 | Erickson, Jr. | 254/104 |
| 4,183,503 | 1/1980 | Ward | 254/18 |
| 4,427,182 | 1/1984 | Marik | 254/131 |
| 5,165,659 | 11/1992 | L'Heureux | 254/17 |
| 5,176,363 | 1/1993 | Bowlin | 254/131 |
| 5,447,289 | 9/1995 | Callahan | 254/131 |
| 5,459,897 | 10/1995 | Wurdack | 7/166 |
| 5,813,295 | 9/1998 | Jensen, Jr. . | |
| 5,836,222 | 11/1998 | Harpell . | |

*Primary Examiner*—Timothy V. Eley
*Assistant Examiner*—Willie Berry, Jr.
*Attorney, Agent, or Firm*—Carrier, Blackman & Associates, P.C.; William D. Blackman; Joseph P. Carrier

[57] ABSTRACT

A device for dismantling roofing materials from a roof. The device is used for removing nails, shingles, ice, carpets, sheathing and to chop through a roof for fire fighting purposes. The body of the device is cast steel. Wings or a cam allow the device to be used on the side of a 2×4, rather than being centered over a 2×4. The cast steel imparts heft to the device to make the process of dismantling easier. Webbed or rounded root teeth on the leading edge facilitate ripping of shingles and nails. Various embodiments have a sledge hammer, an ax head, a pickhead, a prybar, a pike tool, a ripper, and wings.

16 Claims, 2 Drawing Sheets

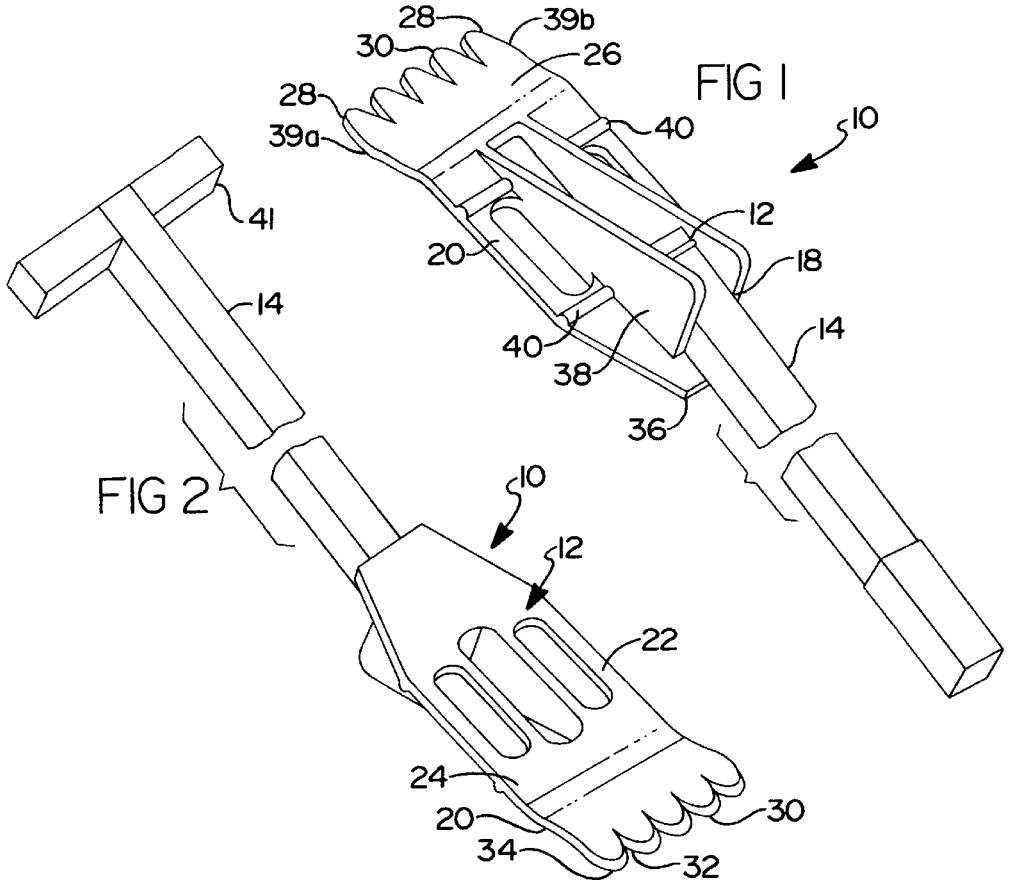
FIG 1
FIG 2
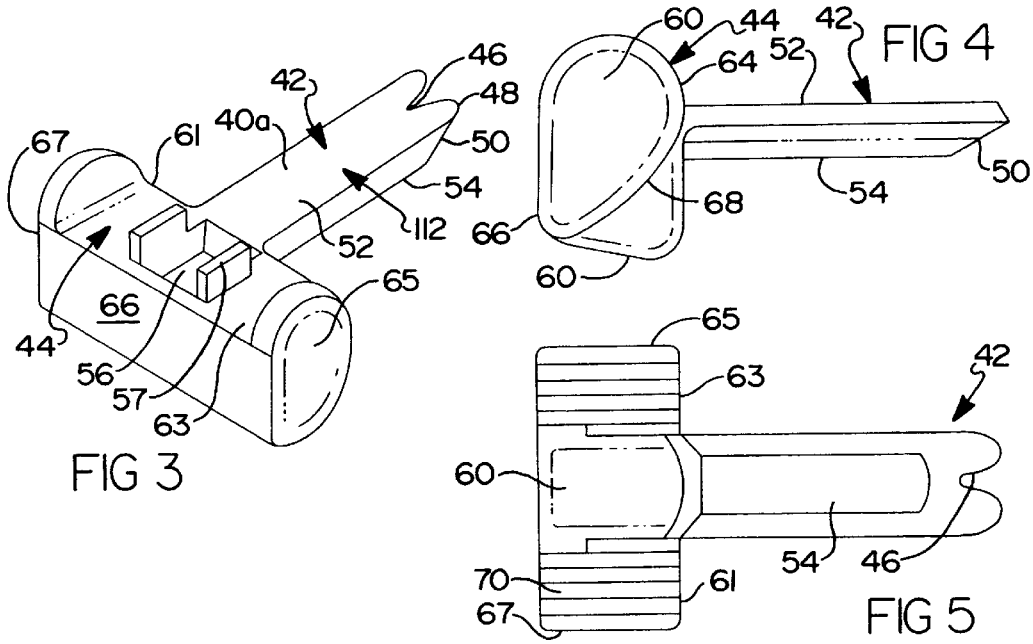
FIG 4
FIG 3
FIG 5

606
616
617
604
212
614
611
612
640

640
210
614
611
612
604
617
616
212
606
315
320
330
630
214
620
304
306
314
300
312
310
318
322
316
308
302

415
420
430

404
410
400
412
414
408
422
416
406
402

FAMILY OF DISMANTLING DEVICES

BACKGROUND OF THE INVENTION

The field of the invention pertains to tools for firefighters, law enforcement, roofers, construction workers, the handyman, the tradesman, and for others requiring tools for dismantling tasks. The invention pertains to tools or devices which are shown in three main configurations.

One device is a dismantling combination tool of six tools in one for prying, ripping, removing, splitting, hammering, venting and other dismantling tasks as needed by firefighters, law enforcement, construction workers, roofers, handymen.

Another device is configured for dismantling roofing materials such as nails and shingles, and for carpet and ice removal.

A third configuration is a device for dismantling deck boards, sheathing, 2×4's, and wooden pallets.

Fork type tools have been used in the past for dismantling work. However, the fork type tools require that the tool be centered and pivoted on a beam such as a 2×4. Most known dismantling tools are lightweight in construction. No provision has been made for one piece cast steel solid hefty tools for dismantling materials.

Examples of the known art are shown in the following U.S. Pat. No. 5,447,289 to Callahan for an S shaped shovel having a thin blade; U.S. Pat. No. 5,176,363 to Bowlin for a lift bar; U.S. Pat. No. 5,165,659 to L'Heureux for a roof opener; U.S. Pat. No. 4,183,503 to Ward for a demolition tool; U.S. Pat. No. 3,074,694 to Erickson, Jr. for a roof-nail spud; U.S. Pat. No. 2,680,003 to Feinstein for a ripping bar; U.S. Pat. No. 1,559,976 to Ness for a wrecking bar; U.S. Pat. No. 4,427,182 to Marik for a stake and form removal device; U.S. Pat. No. 2,852,228 to Latiolais for a wrecking tool; U.S. Pat. No. 2,330,092 to Vanasse for a combination tool; U.S. Pat. No. 5,459,897 to Wurdack for a tool for lifting and removing carpet; and U.S. Pat. No. 738,753 to Baggett for a combination tool.

The Callahan patent discloses a tool for removing wooden pallet deck boards. The Bowlin patent shows a forked lift bar centered over a support beam. The L'Heureux patent teaches a device having spaced tines and reinforcement members underneath. The Ward patent shows a double ended tool with differently shaped prying members at opposite ends. The Erickson, Jr. patent shows a multiple plate tool for removing nail and roofing material. The Feinstein patent discloses a ripping bar with two tines for removing wall board. The Ness patent teaches a wrecking bar having two tines on one end and a bent arm at the other end.

The Marik patent has a box-like portion at one end for removing forms from a formed concrete structure. The opposite end of the Marik device contains a beveled tool. The Latiolais device has two obtusely angular legs with an upwardly curving fulcrum portion that is mechanically assembled. The Vanasse patent shows a crow bar with a wire breaking implement and a nail puller at opposite ends. The Wurdack patent teaches a tool for lifting furniture and for removing glued down carpet. The Baggett patent shows a combination tool having a V-shaped cleft at a chisel end and a backward facing nail-pulling claw and wedge with a lug disposed beneath. Although these patents discuss dismantling tasks, none show a dismantling device having a solid cast steel body.

SUMMARY OF THE INVENTION

It is an object of the invention to provide dismantling devices that are solid and useful to apply force to the task of dismantling.

It is an object of the invention to provide a dismantling tool that saves time from carrying many tools, a combination tool with six tools in one, especially, when in need instantly for firefighting.

It is an object of the invention to provide a dismantling tool that eliminates gouging of the sheathing when removing roofing, being more cost effective, saving time and effort.

It is also an object of the invention to provide dismantling devices that are pivotable against a side of a structural beam.

It is a further object of the invention to provide a ripping device which is convenient to use for dismantling purposes.

The tools of the invention have a solid body with a leading edge and a handle positioning location for balance. The tool head is made from a one-piece casting, preferably from cast steel in order to impart heft of the tool. The majority of the weight of the tool is placed at the tool head.

The tool handle can be a 1" square bar with a cross handle. Appropriate lengths for the handle can be selected for the intended purpose. For example, a handle 24" to 42" is useful for a tool having upper and lower wedge arms. For demolition purposes, a handle having a length of 24" to 42" is appropriate. For roofing purposes, a handle having a length of 10" to 48" is appropriate. The handles can be welded to the tool head.

One configuration of the body has a lower and an upper wedge arm, with wings perpendicularly disposed from the lower wedge arm. The wings are operable with the tool laterally offset from the 2×4 ripping. The upper wedge arm is shorter than the lower wedge arm. The leading edges of both the wedge arms are tapered and vary in sizes. Depending on the application this configuration can be modified with a sledge hammer, an ax blade, a pickhead, prybar, and pike tool.

A handle receiving slot extends diagonally away from the upper wedge arm. A boss running part way from the back towards the leading edge is provided on the bottom surface of the upper wedge arm. The boss helps the body to be rocked by the user. This configuration is particularly helpful for use with sheathing that edges against the end of a 2×4. The lower wedge is inserted under the sheathing and then the tool is rocked up and down to advance the wedge under the sheathing.

Another configuration of the body takes a tee shape with a cross arm and a tongue extending normally from the cross arm. The tongue is generally planar across the entire top surface but is planar across only part of the lower surface, having a taper from the top surface to the lower surface. A recess is provided in the cross arm aligned with the tongue. Ears aligned with the tongue rise from the planar surface adjacent to the recess. A handle fits into the recess and is supported by the ears.

There are wings at the ends of the cross arm which take a semicircular shape above the planar surface and function as hammerheads. The cross arm functions as a cam for pivoting the tool when the tool is laterally offset from a 2×4. The cross arm extends vertically on the back of the body and then flows into a radiused shape beneath the planar surface. The radiused shape extends from the ends of the cross arm to the width of the tongue. Radiused serrations or grooves are provided in the radiused shape to allow the tool to be offset from a 2×4 without slipping. The underside of the cross arm at the center has the width of the tongue and extends perpendicularly from the vertical back of the body and functions as a hammerhead.

A third configuration of the tool body or head has a generally planar rectilinear lower surface with a downward tilt toward the leading edge. A planar tab extends from the rectilinear lower surface opposite the leading edge. The planar tab underlies and supports tapered bosses that rise from the upper surface. The bosses are tapered from the back towards the leading edge. The leading edge has teeth with oval or webbed roots that are reduced from the top surface to the bottom surface. The tapered oval roots of the teeth prevents the tool from digging or gouging into the sheathing and roofing. Raised integral members are disposed parallel with the leading edge on the top of the body. A handle fits between the bosses.

The family of tools can be used in plumbing, electrical work, roofing, fire fighting, law enforcement, construction, and recycling of wooden pallets. The tools can be made in various sizes.

For a more complete understanding of the present invention, reference is made to the following detailed description when read in conjunction with the accompanying drawings wherein like reference characters refer to like elements through the several views.

BRIEF DESCRIPTION OF THE DRAWINGS

FIG. 1 illustrates a perspective view of a first embodiment of the invention having a generally planar bottom and side;

FIG. 2 illustrates a perspective view of the tool head of the first embodiment with tee handle showing the tool inverted 180 degrees from the view of FIG. 1;

FIG. 3 illustrates a perspective view of a tee shaped tool head according to a second embodiment of the invention;

FIG. 4 illustrates a side view of the wings (also used as hammerheads) of the tee shaped tool head of FIG. 3;

FIG. 5 illustrates a bottom view of the tool head of FIGS. 3–4, showing serrations on the wings of the tee shaped tool head with center used as a hammerhead;

DESCRIPTION OF THE PREFERRED EMBODIMENTS

Figures 6, 7, 8, 9:
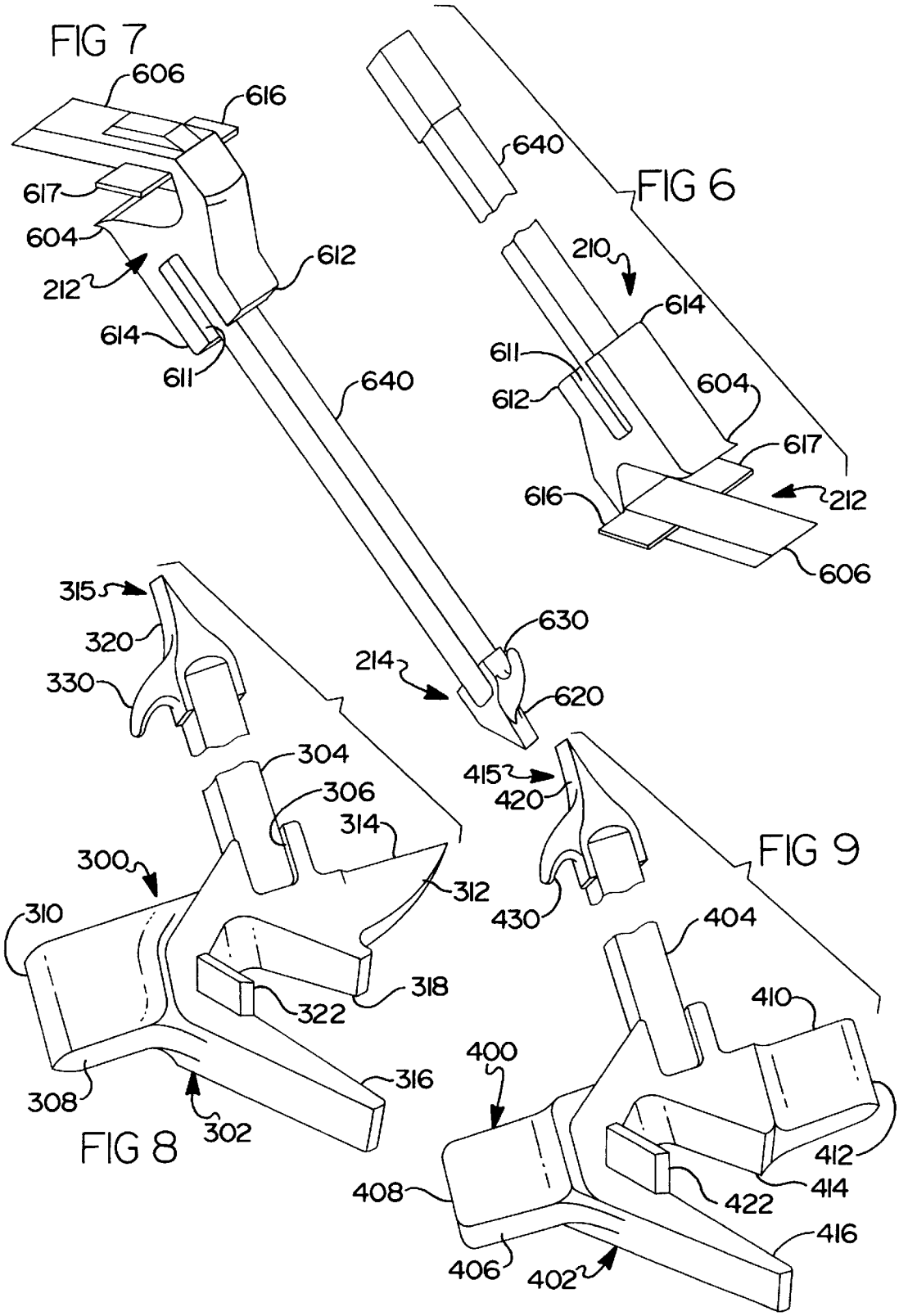
FIG. 6 illustrates a perspective view of a tool according to a third embodiment of a ripping tool with upper and lower wedge arms and with wings of various sizes according to the invention.
FIG. 7 illustrates a perspective view of the tool of FIG. 6, showing the tool inverted 180 degrees from the previous view, with wings and modified to include a prybar, and pike tool on the handle.
FIG. 8 illustrates a side view of the FIG. 6 and 7 tool further modified and including ax, pickhead, prybar, and pike tool.
FIG. 9 illustrates a side view of yet another modified version of the tool of FIG. 8 with sledge hammer and axhead.

FIGS. 1 and 2 show a preferred tool 10. Tool 10 is used for dismantling roofing, and for removing ice and carpeting materials and comprises a head 12 and a tee handle 14. Handle 14 is rigidly attached to head 12, such as by welding at 18. A 1" tubing handle 41 may be attached to the outer end of handle 14. Head 12 has a central section with a top surface 20 and a bottom surface 22, the central section having a generally rectilinear planar shape 24. A downwardly extending portion 26 from bottom surface 22 terminates in a leading edge 28 having teeth 30. Teeth 30 are interconnected by rounded or webbed indentations or roots 32 and the outermost edges of teeth 30 are chamfered or reduced at 34 from top surface 20 towards bottom surface 22 of head 12. A planar heel 36 extends from head 12 opposite leading edge 28. Upwardly rising bosses 38 extend from heel 36 towards leading edge 28. Raised integral ridges 40 are disposed on top surface 20, perpendicular to bosses 38.

The head has a pair of shoulders 39*a* and 39*b* on opposite sides of the leading edge so the sides of the head do not scrape a structural wall when the tool is in use.

FIGS. 3–5 show another configuration of a tool head 112 in accordance with a second embodiment of the invention. In this embodiment, the tool head 112 has a tee shape 40A with a tongue 42 and a cross arm 44. Tongue 42 has a vee slot 46 in end 48, and is tapered at 50 from top surface 52 towards bottom surface 54. A handle-receiving recess 56 is formed in the top surface at the intersection of tongue 42 with cross arm 44. A first hammerhead 60 (FIG. 5) is formed in the bottom surface 54 at the intersection of tongue 42 with cross arm 44. Ears 57 are adjacent cross arm 44 on opposite sides of the recess. Recess 56 and ears 57 locate the end of an elongated handle (not shown) in position.

FIG. 4 depicts tool head 112 with a planar bottom surface 54 below tongue 42 and parallel to the tongue. The ends of cross arm 44 have wings 61, 63 which terminate in second and third and hammerheads 65, 67. Each wing 61, 63 has an upper semicircular shape 64 that merges with the vertical back 66 of the tool head 112. Back 66 is disposed generally at right angles to tongue 42. Each wing 61, 63 has a radiused cam-like shape 68 as it extends from the top surface 52 of the tongue 42 down to the lowermost portion of the back 66.

FIG. 5 shows serrations or grooves 70 which may be formed in each of the wings 61, 63 along the radiused can shape 68, opposite the back 66.

FIG. 6 shows another configuration of a tool 210, according to a third embodiment of the present invention, having a tool head 212 with an upper wedge arm 604 and a parallel lower wedge arm 606. Wings 616, 617 extend in opposite directions on the tool head 212 and perpendicular to the base of lower wedge arm 606. Upper wedge arm 604 is shorter than lower wedge arm 606 to permit the easy insertion of a board between the two wedge arms. The leading edges of the wedge arms 604, 606 are tapered away from the top surfaces thereof, as shown, and the wedge arms 604, 606 are spaced apart from one another, as shown, so as to define a pocket therebetween for receiving material to be dismantled. The tool head 212 has a recess 611 formed therein between opposed flanges 612, 614 to retentively receive a handle 640.

FIG. 7 shows the same tool as FIG. 6 modified by the addition of a secondary tool head 214. In the embodiment of FIG. 7, the secondary tool head 214 is attached to the handle 640 at the end thereof opposite the primary tool head 212. The secondary tool head 214 provides a prybar 620 and pike tool 630 on the handle 640.

FIG. 8 illustrates a fourth embodiment of a tool 300 according to the invention which comprises a combination of six tools in one. The tool head 302 is preferably made of cast steel and a steel handle 304 is received into a slot 306 and welded to the tool head. It has an axhead 308 having a striking edge 310 extending in a direction generally parallel to the longitudinal axis of handle 304. The tool head 302 includes a pickhead opposite the axhead 308, which has a tapered point 312 and a straight edge 314 which is generally at a right angle to the longitudinal axis of handle 304. This embodiment of the invention also has a pair of slightly divergent wedge arms 316 and 318 with wings such as that shown at 322 extending outwardly from opposite sides of the lower wedge arm 316, for dismantling a board from a 2×4. The wedge arms 316, 318 are oriented at an angle with respect to handle 304. In the embodiment of FIG. 8, a secondary tool head 315 is attached to the handle 304 at the end thereof opposite the primary tool head 302. The secondary tool head 315 is provided with prybar 320 and pike tool 330.

FIG. 9 illustrates another embodiment of a tool 400 according to the invention which comprises a cast steel tool head 402 and a steel handle 404. This embodiment of the invention is similar to the embodiment of FIG. 8 in that it has a sledge hammerhead 406 with a planar striking surface 408 disposed in a plane generally parallel to the longitudinal axis of handle 404. This embodiment also has an axhead 410 with a striking edge 412 disposed generally parallel to the longitudinal axis of handle 404. The axhead 410 extends in the opposite direction on the body of the tool head 402 from the sledge hammer. This embodiment also has a pair of slightly divergent tongues 414 and 416 which are identical to the wedge arm structures 316, 318 of FIG. 8, with wings 422. This tool 400 also has a secondary tool head 415 attached to opposite end of the handle 404 from the primary tool head 402. The secondary tool head 415 is substantially identical to the secondary tool head 315 of FIG. 8. Once again, in this embodiment, the secondary tool head 415 supplies the user with prybar 420 and pike tool 430.

Having described my invention, many modifications thereto will become apparent to those skilled in the art to which it pertains without deviating from the spirit of the invention as defined in the appended claims.

I claim:

1. A dismantling device comprising:

a body having a central section with a top and a bottom, the bottom being a generally rectilinear planar surface;

said body further comprising a downwardly extending portion attached to the central section and having a leading edge, the downwardly extending portion being disposed at an obtuse angle with respect to said central section and being rigidly attached thereto;

said leading edge terminating in a plurality of teeth which are interconnected by indentations formed therebetween;

said teeth and indentations therebetween being exclusively confined to said downwardly extending portion of said body;

at least one upwardly rising boss extending upwardly from the top of the body;

said upwardly rising boss tapering towards the leading edge of said body; and at least one raised integral member being normal to said at least one upwardly rising boss.

2. The dismantling device according to claim 1 further comprising an integral planar tab extending from said generally flat bottom of the body opposite the leading edge.

3. The dismantling device according to claim 1 wherein the body comprises cast steel.

4. The dismantling device of claim 1, further comprising a handle which is rigidly attached to said body.

5. The dismantling device according to claim 4 wherein the means for affixing said handle to said body comprises welding.

6. The dismantling device according to claim 4 wherein the means for affixing said handle to said body further comprises weldments between said handle and said boss on the body.

7. A dismantling device comprising:

a body having a central section with a top and a bottom, the bottom being a generally rectilinear planar surface;

said body further comprising a downwardly extending portion attached to the central section and having a leading edge, the downwardly extending portion being disposed at an obtuse angle with respect to said central section and being rigidly attached thereto;

said leading edge terminating in a plurality of teeth which are interconnected by indentations formed therebetween;

said teeth and indentations therebetween being exclusively confined to said downwardly extending portion of said body;

a plurality of upwardly rising bosses attached to said body central section and extending upwardly from the top of the body;

said upwardly rising boss tapering towards the leading edge of said body; and at least one integral cross member disposed between the upwardly rising bosses.

8. A dismantling device for dismantling materials from a roof, ice, carpets, and pallets the device comprising;

a generally tee shaped body having a tongue and a cross arm, a top and a bottom;

the top being a generally planar surface having a recess and ears above the planar surface;

the recess and the ears being aligned with the tongue, the tongue having a width and terminating in a vee slot;

the bottom having a first planar surface under the cross arm, the first planar surface being the width of the tongue and functioning as a hammerhead;

a second planar surface under the tongue, the second planar surface being closer to the top surface and tapering to the end of the vee slot;

wings functioning as hammerheads disposed on each of two ends of the cross arm, said wings having a semicircular shape from the top planar surface, a vertical back surface, and a radiused shape extending from the back surface towards the top planar surface, the semicircular shape of said wings being near the two ends of the cross arm; and wherein said radiused shape extends from the ends of the cross arms to the tongue, the radiused shapes having radiused serrations thereon.

9. The dismantling device according to claim 8 further comprising a handle affixable to said body, in the recess between the ears.

10. A dismantling device comprising:

a body having a lower wedge arm extending outwardly thereon and with a leading edge;

a plurality of wings integrally attached to and extending perpendicularly from said lower wedge arm;

said body also having an upper wedge arm having a leading edge, said upper wedge arm being disposed above and substantially parallel to said lower wedge arm said upper wedge arm being spaced away from said lower wedge arm so as to define a pocket therebetween for receiving material to be dismantled; and means for receiving a handle.

11. The dismantling device according to claim 10, wherein said handle has a prybar and a pike tool on the end.

12. The dismantling device according to claim 10 wherein each of the upper wedge arm and lower wedge arm have a top and a bottom, the upper wedge arm and the lower wedge arm being tapered away from the leading edge at the top towards the bottom thereof.

13. The dismantling device according to claim 10 wherein lower wedge arm has a planar bottom, and including a boss disposed on said bottom between the back and part way towards the leading edge of said lower wedge arm.

14. The dismantling device of claim 10, wherein said body, said upper wedge arm, said lower wedge arm, and said wings are parts of an integral unit.

15. A dismantling tool, comprising a cast steel tool head having means for attaching an elongated handle with a prybar and a pike tool, the head having a slot for receiving the lower end of a handle along an axis, an integral sledge hammerhead extending from the tool head in a first direction generally transverse to the axis of the handle, a pickhead extending in the opposite direction to the sledge hammerhead and a tongue extending at an acute angle with respect to the axis of the handle with the prybar and the pike tool, the tongue forming a slot having an opening disposed between the sledge head and the pickhead, the tongue being suited for insertion into a structure for dismantling.

16. A dismantling device for dismantling materials, comprising a cast steel body comprising:

a lower wedge arm with a leading edge;

integrally formed wings attached to and extending outwardly from opposite sides of said lower wedge arm;

a back portion connected to said lower wedge arm;

an upper wedge arm having a leading edge, the upper wedge arm being connected to said back portion in a spaced parallel relationship to the lower wedge arm so as to define an open pocket therebetween for receiving material to be dismantled;

a heel extending from said back opposite the wedge arms; and means for receiving a handle in said body.

* * * * *